US006806465B2

(12) United States Patent
Anderson et al.

(10) Patent No.: US 6,806,465 B2
(45) Date of Patent: Oct. 19, 2004

(54) SAMPLE COLLECTION PREPARATION METHODS FOR TIME-OF FLIGHT MINIATURE MASS SPECTROMETER

(75) Inventors: Charles W. Anderson, Columbia, MD (US); Peter F. Scholl, Silver Spring, MD (US); Ronald G. Chappell, Columbia, MD (US); Wayne A. Bryden, Columbia, MD (US); Harvey W. Ko, Ellicott City, MD (US); Scott A. Ecelberger, Laurel, MD (US)

(73) Assignee: The Johns Hopkins University, Baltimore, MD (US)

( * ) Notice: Subject to any disclaimer, the term of this patent is extended or adjusted under 35 U.S.C. 154(b) by 51 days.

(21) Appl. No.: 10/031,041

(22) PCT Filed: May 23, 2001

(86) PCT No.: PCT/US01/16697

§ 371 (c)(1),
(2), (4) Date: Jan. 15, 2002

(87) PCT Pub. No.: WO01/93307

PCT Pub. Date: Dec. 6, 2001

(65) Prior Publication Data

US 2003/0020011 A1 Jan. 30, 2003

Related U.S. Application Data

(60) Provisional application No. 60/207,825, filed on May 30, 2000.

(51) Int. Cl.[7] ..... H01J 49/40; H01J 49/04

(52) U.S. Cl. ..... 250/287; 250/288

(58) Field of Search ..... 250/287, 288, 250/289

(56) References Cited

U.S. PATENT DOCUMENTS

| | | | | | |
|---|---|---|---|---|---|
| 3,922,546 | A | * | 11/1975 | Livesay | 250/310 |
| 4,296,322 | A | * | 10/1981 | Wechsung | 250/282 |
| 4,757,396 | A | * | 7/1988 | Ishiguro et al. | 360/69 |
| 4,819,477 | A | * | 4/1989 | Fisher et al. | 73/28.01 |
| 5,376,788 | A | * | 12/1994 | Standing et al. | 250/287 |
| 2003/0020011 | A1 | * | 1/2003 | Anderson et al. | 250/287 |

* cited by examiner

*Primary Examiner*—John R. Lee
*Assistant Examiner*—James J. Leybourne
(74) *Attorney, Agent, or Firm*—Francis A. Cooch

(57) ABSTRACT

A field portable mass spectrometer system comprising a sample collector and a sample transporter. The sample transporter interfaces with the sample collector to receive sample deposits thereon. The system further comprises a time of flight (TOF) mass spectrometer. The time of flight mass spectrometer has a sealable opening that receives the sample transported via the sample transporter in an extraction region of the mass spectrometer. The system further comprises a control unit that processes a time series output by the mass spectrometer for a received sample and identifies one or more agents contained in the sample.

25 Claims, 4 Drawing Sheets

SAMPLE COLLECTION PREPARATION METHODS FOR TIME-OF FLIGHT MINIATURE MASS SPECTROMETER

This application claims the benefit of Provisional Application No. 60/207,825 filed May 30, 2000.

FIELD OF THE INVENTION

The invention relates to a time-of-flight (TOF) miniature mass spectrometer (MMS), and more particularly to an automated TOF MMS collection, measurement and analysis system for acquisition of mass spectra.

DESCRIPTION OF THE RELATED ART

One of the most powerful laboratory tools for analyzing a broad spectrum of chemical and biological material is the mass spectrometer. Mass spectrometry is a proven technique for analyzing many types of environmental samples. Mass spectrometry is used to determine the masses of molecules formed following their vaporization and ionization. Detailed analysis of the mass distribution of the molecule and its fragments leads to molecular identification. Mass spectrometry is especially suited for aerosol analysis because micrometer-sized heterogeneous particles contain only about $10^{-12}$ moles of material and thus requires a sensitive technique such as mass spectrometry for proper analysis. Liquid samples can be introduced into a mass spectrometer by electrospray ionization (1), a process that creates multiple charged ions. However, multiple ions can result in complex spectra and reduced sensitivity.

A preferred technique, matrix assisted laser desorption time-of-flight mass spectrometry (MALDI-TOF-MS), has become popular in the analysis of biological polymers for its excellent characteristics, such as ease of sample preparation, predominance of singly charged ions in mass spectra, sensitivity and high speed. Time-of-flight MALDI-TOF-MS is established as a method for mass determination of biopolymers and substances such as peptides, proteins, and DNA fragments. The analytical sensitivity of TOF MS is such that under the right conditions only a few microliters of analyte solution at concentrations down to the attomolor ($10^{-12}$ moles) range are required to obtain a mass spectrum. The MALDI-MS technique is based on the discovery in the late 1980s that desorption/ionization of large, nonvolatile molecules such as proteins can be effected when a sample of such molecules is irradiated after being co-deposited with a large molar excess of an energy-absorbing "matrix" material, even though the molecule does not strongly absorb at the wavelength of the laser radiation. The abrupt energy absorption initiates a phase change in a microvolume of the absorbing sample from a solid to a gas while also inducing ionization of the sample molecules. Detailed descriptions of the MALDI-TOF-MS technique and its applications may be found in review articles by E. J. Zaluzed et al. (Protein Expression and Purifications, Vol. 6, pp. 109–123 (1995)) and D. J. Harvey (Journal of Chromatography A, Vol. 720, pp. 429–4446 (1996)), each of which is incorporated herein by reference.

In brief the matrix and analyte are mixed to produce a solution with a matrix:analyte molar ratio of approximately 10,000:1. A small volume of this solution, typically 0.5–2. microliters, is applied to a stainless steel probe tip and allowed to dry. During the drying process the matrix codeposits from solution with the analyte. Matrix molecules, which absorb most of the laser energy, transfer that energy to analyte molecules to vaporize and ionize them. Once created, the analyte ions the ions formed at the probe tip are accelerated by the electric field toward a detector through a flight tube, which is a long (on the order of 0.15 to 1 m) electric field-free drift region. Since all ions receive the same amount of energy, the time required for ions to travel the length of the flight tube is dependent on their mass to charge ratio. Thus, low-mass ions have a shorter time of flight (TOF) than heavier ions. All the ions that reach the detector as the result of a single laser pulse produce a transient TOF signal. Typically, ten to several hundred transient TOF mass spectra are averaged to improve ion counting statistics. The mass of an unknown analyte is determined by comparing its experimentally determined TOF to TOF signals obtained with ions of known mass. The MALDI-TOF-MS technique is capable of determining the mass of proteins of between 1 and 40 kDa with a typical accuracy of +–0.1%, and a somewhat lower accuracy for proteins of molecular mass above 40 kDa. The ability to generate UV-MALDI mass spectra is critically dependent upon the co-crystallization or very close special proximity of the analyte and a molar excess of the matrix compound. In routine practice, a small volume of matrix solution that delivers a one thousand-fold molar excess of matrix is manually mixed with a small volume of the analyte solution which then dries on a sample stage. A spatially heterogeneous distribution of analyte and matrix typically develops as the droplet dries to form a sample spot. Under laboratory conditions, the incident laser is rastered across the sample to identify so called "sweet spots" that preferentially yield for an abundance of analyte ions. Although a motorized x-y stage may be incorporated for automated searching for the spot providing the best spectrum, this procedure can be a time consuming step.

MALDI is typically operated as an offline ionization technique, where the sample, mixed with a suitable matrix, is deposited on the MALDI target to form dry mixed crystals and, subsequently, placed in the source chamber of the mass spectrometer. Although solid samples provide excellent results, the sample preparation and introduction into the vacuum chamber requires a significant amount of time. Even simultaneous introduction of several solid samples into a mass spectrometer or off-line coupling of liquid-phase separation techniques with a mass spectrometer do not use TOF mass spectrometer time efficiently.

To improve on these procedures, microfabricated targets have recently been developed for automated high throughput MALDI analysis. In these designs, pL-nL sample volumes can be deposited into a microfabricated well with dimensions similar to the spot size of the desorbing laser beam about 100 micrometers to 1,000 micrometers diameter). Thus, the whole sample spot can be irradiated and the search for the "sweet spot" eliminated. Analysis of short oligonucleotides has been demonstrated with about 3.3 s required to obtain a good signal to noise ratio for each sample spot. Although the total analysis time, including the data storage, takes nearly an hour, theoretically all 96 samples could be recorded in about five minutes.

While the miniaturization of the sample target simplifies the static MALDI analysis, on-line coupling would allow continuous analysis of liquid samples including direct sample infusion and the monitoring of chromatographic and electrophoretic separations. Compared to ESI, MALDI provides less complex spectra and, potentially, higher sensitivity. There have been numerous reports in the literature about the MALDI analysis of flowing liquid samples. In one arrangement, the sample components exiting a CE separation capillary were continuously deposited on a membrane presoaked with the matrix and analyzed after drying. In other cases, the liquid samples were analyzed directly inside the mass spectrometer using a variety of matrices and interfaces. MALDI was then performed directly off rapidly dried droplets. In another design, a continuous probe, similar to a fast atom bombardment (FAB) interface, was used for the analysis of a flowing sample stream with liquid matrix. Glycerol was used to prevent freezing of the sample. Other attempts for liquid sample desorption were also made using fine dispersions of graphite particles and liquid matrices instead of a more conventional matrices. More recently, an outlet of the capillary electrophoresis column was placed directly in the vacuum region of the TOF mass spectrometer. The sample ions, eluting in a solution of CuCl.sub.2, were desorbed by a laser irradiating the capillary end. On line spectra of short peptides separated by CE were recorded. Attempts to use ESI to introduce liquid sample directly to the evacuated source of a mass spectrometer have also been reported.

Standard MALDI sample preparation techniques as just discussed are not applicable to a real-time TOF-MS systems, the constraints of which do not permit either the analyte and matrix to be mixed in solution or the laser to be rastered across the sample. An additional major design goal of a real-time system is increased throughput speed by avoiding or minimizing the extent to which samples must be processed prior to acquisition of mass spectra. Since MALDI-MS is being used, ideally it is preferred to intimately mix the concentrated sample with a large molar excess of MALDI matrix to produce a uniform analyte-matrix lattice across the sample spot. An alternate technique of depositing an analyte sample in aerosol form directly on a bare collection substrate, or pre-coated surface with a MALDI matrix might not provide the degree of intimate mixing and co-crystallization of the analyte with the matrix that for generation of high quality UV-MALDI mass spectra. Thus, with this second method, additional post-collection steps, e.g., over-spraying with MALDI matrix, may be required.

Another shortcoming of current TOF MS designs are the long pump-down times associated with the introduction of the samples into the vacuum chamber. In the operation of a conventional mass spectrometer a test sample must be introduced through a valve into a vacuum chamber to a location less than a millimeter from an ion extraction source. The introduction of a sample into the MMS vacuum chamber in a real-time system requires rapid sample exchange while maintaining a high vacuum. Current mass spectrometer models require about 5 minutes to pump-down to high vacuum after the introduction of a new sample. A pump-down time of seconds would better meet the requirements of a real-time device.

Although the above-listed examples show efforts to address various different problems related to sample preparation and extraction for a real-time spectrometer, currently there is no-real time device that would permit continuous on-line processing of multiple samples. A device for continuous introduction of individual samples into a time-of-flight mass spectrometer so that on-line MALDI-MS analysis can be carried out would be highly desirable.

SUMMARY

In view of the above described state of the art, the present invention seeks to realize the following objects and advantages.

It is a primary object of the present invention to provide a mass spectroscopic analysis system and method which is fully automated requiring no operator interaction.

It is also an object of the present invention to provide a mass spectroscopic analysis system which is portable and reliable enough to survive transport on a range of vehicles, allows handling by two persons, and operates from a portable power source.

It is also an object of the present invention to provide a mass spectroscopic analysis system and method which can carry out spectrographic analysis results faster than previously possible.

It is also an object of the present invention to provide a mass spectroscopic analysis system and method that is suitable for field applications.

It is another object of the present invention to provide a mass spectroscopic analysis system and method which includes provisions for thoroughly mixing an analyte with a matrix composition, thus facilitating real-time spectral analysis.

It is a further object of the present invention to provide a mass spectroscopic analysis system and method which may use, but does not necessarily, require post-collection fluid matrix processing prior to performing a mass spectral analysis.

It is also a further object of the present invention to provide a mass spectroscopic analysis system and method which reduces contamination of the procedure.

It is also an object of the present invention to provide a mass spectroscopic analysis system and method provides a permanent storage medium that has the ability to record pertinent data associated with the collection and measurement of the sample.

It is also a further object of the present invention to provide a mass spectroscopic analysis system and method which includes an external ionization source and electrostatic lens, thus removing the necessity of inserting the sample into the mass spectrometer's vacuum chamber, thus keeping vacuum pump-down times to a minimum and allowing real-time spectral analysis.

It is a further object of the present invention to provide a mass spectroscopic analysis system and method which promotes rapid throughput and utility of MALDI-TOF MS.

It is also an object of the present invention to capture infectious and toxic agents on a substrate in small spots that allow maximum coverage by an irradiating laser beam. The beam may cover less than about 0.1 mm diameter to greater than 1.0 mm in diameter.

It is another object of the present invention to provide a mass spectroscopic analysis system and method which provides for a variety of techniques for applying and mixing matrix with analyte, thus facilitating real-time spectral analysis.

These and other objects and advantages of the invention will become more fully apparent from the description and claims which follow, or may be learned by the practice of the invention.

As will be appreciated, the present invention provides an automated mass spectroscopic analysis system that may be characterized as an "end-to-end" process of sample collection, preparation, measurement and analysis. The present invention is distinguishable from prior art approaches in that conventional approaches are neither integrated nor automated. That is, in the prior art each process is manually performed under operator control and guidance. In accordance with the present invention, a mass spectroscopic analysis systems is provided which performs the following method steps: (1) collect, concentrate, and separate aerosols from breathable ambient air at concentrations on the order of 15 ACPs per liter of air and of 0.5 to 10.0 um aerodynamic diameter. It should be noted that while concentrations on the order of 15 ACPs per liter and of 0.5 to 10.0 um aerodynamic diameter are described, other particle concentrations and densities are also within the contemplation of the present invention; (2) capture infectious and toxic agents from the collected, concentrated and separated aerosols on a continuous substrate (e.g., flexible tape) in small spots that allow coverage by an irradiating laser beam on the order of 1.0 mm in diameter. It should be noted that using a laser with a spot size greater than or less than 1.0 mm in diameter is also within the contemplation of the present invention; (3) prepare the collected samples for the MALDI process by adding a matrix, (4) introduce the collected samples directly into the analysis system in real-time on the continuous substrate. That is, after collection is completed for each sample, the tape transports the sample into a time-of-flight (TOF) mass spectrometer analyzer. The apparatus of the present invention provides a novel vacuum interface which advantageously reduces the vacuum pump loading by isolating the main vacuum chamber from the sample port around the tape sample when samples are being changed. The vacuum interface is formed in part by utilizing the tape as a temporary boundary to form a vacuum chamber seal at or below micro-Torr pressure levels and (5) once inside the high vacuum chamber, a laser than ionizes the sample, and the resulting mass spectrum is analyzed for specific biomarkers that indicate the presence and identity of a biological agent.

The automated system of the present invention provides a number of advantages over prior art approaches including, a minute volume of fluid required for sample processing, eliminating the need for large storage reservoirs, stationary and level mounting configurations, or large power-hungry heating and cooling systems. Further advantages include the concurrent collection of multiple samples, allowing both the application of different analysis protocols and the archiving of samples for later confirmatory analysis.

In practice of the method of the invention, a sample is placed on a permanent storage medium (e.g., a VCR tape) that limits cross sample contamination and undergoes a variation of a matrix-assisted laser desorption/ionization (MALDI) preparation. Each sample is then advanced on the tape to the mass spectrometer analyzer for acquisition of mass spectra. A movable platen forces the tape against a sealing surface, thus creating a vacuum seal with an external vacuum chamber. A triggered laser and an external electric field ion extraction source provides the necessary ionization to initiate mass spectra analysis using a time-of-flight mass spectrometer. When the analysis is complete, the tape advances and a new sample can be analyzed.

Although the analyzer of the invention is achievable in a number of configurations, an acceptable configuration includes: (1) An aerosol interface including a particle collector/impactor stations for collecting, concentrating, and separating analyte from the sample aerosol. A nebulizer for injecting MALDI matrix particles into a sample aerosol upstream of one or more tape particle collector/impactor stations. Continuous tape substrate to collect, hold, and store the analyte and matrix mixture. The nebulizer is preferably automatically controlled to inject metered amounts of MALDI matrix aerosol from the one or more MALDI dispensers into an incoming air stream bearing the analyte to provide thorough mixing prior to collection on a VCR tape. Typically, the aerosol of interest have concentrations of 15 agent containing particles (ACPs) per liter of air and an aerodynamic diameter 0.5 to 10.0 um, (2) a tape transport system for advancing the concentrated samples into a mass spectrum analyzer instrument one at a time for acquisition of mass spectra while continuously and simultaneously collecting new aerosols (samples). The tape transport system includes one or more closed-loop control motors to independently position the tape both inline with the one or more aerosol collectors and with the inlet to the mass spectrometer, (3) a micro applicator may optionally be included to apply MALDI matrix to the samples after collection or to supplement co-deposited matrix to increase sensitivity; (4) a time-of-flight mass spectrometer including an ionization/desorption cell located outside the walls of the vacuum chamber, and (5) a data acquisition system for collecting data, preferably digitized, to be stored in a computing device.

It is noted that it is within the contemplation of the present invention to perform sample preparation by means other than co-deposition, such as, for example, interspersed collection deposition and a post-collection deposition. Other means not explicitly recited herein are also within the scope of the present invention.

Advantages of the apparatus of the present invention include short analysis times (e.g., less than 5 minutes), high sensitivity, wide agent bandwidth, portability, low power consumption, minimal use of fluids required for sample processing thereby eliminating the need for large storage reservoirs, stationary and level mounting configurations, or large power-hungry heating and cooling systems, extending unattended operation, automated detection and classification, and the concurrent collection of that multiple samples allowing both the application or different analysis protocols and the archiving of samples for later confirmatory analysis.

DETAILED DESRIPTION OF THE PREFERRED EMBODIMENTS

As will be appreciated shortly, the present invention provides an automated spectrographic analysis system which collects biological samples on a permanent storage medium, such as a VCR tape, advances the prepared samples on the tape to a mass spectrum analyzer for acquisition of mass spectra, as well as performing other required steps. The present invention includes an aerosol interface for collecting, concentrating and separating aerosols from breathable ambient air. The aerosol interface uses a modified MALDI sample preparation technique that may co-deposit MALDI matrix as an aerosol with the sample analyte, or include post-collection sample matrix processing before analysis in a mass spectrometer. As will become evident below, the system is designed to run automatically. That is, it may be placed where detection of chemical or biological agents is desired, and it will sample the environment and analyze and identify such agents on an ongoing basis. The present invention solves the problem of carrying out tasks associated with the acquisition of mass spectra quickly and efficiently which has prevented mass spectra analysis from achieving rates which have been long desired in the art.

System Overview

Figure 1:
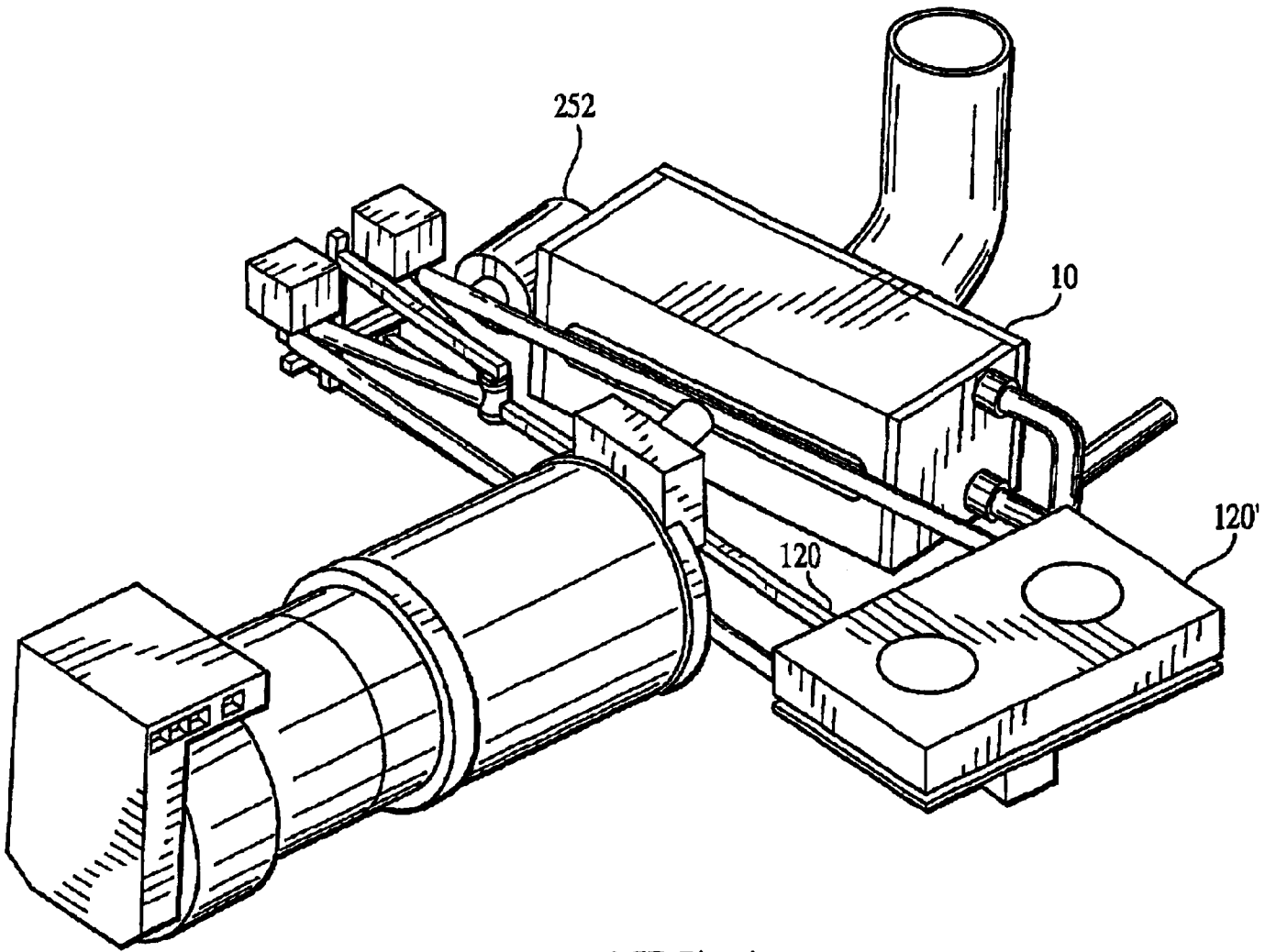
FIG. 1 is a pictorial illustration of a portable analyzer of the invention.

With reference now to the drawings, and particularly to FIG. 1, there is shown a perspective view of a presently preferred embodiment of an automated spectrographic analysis system 100 in accordance with the invention. The system 100 is transportable and sufficiently small and rugged to allow its dependable use in a field environment. Importantly, the system 100 is configured to remain in alignment, even with rough handling. The system 100 is configured to be suitably reliable to survive transportation on a range of vehicles, allow handling by two persons, and to be operable from a portable power source.

Figures 2, 2A:
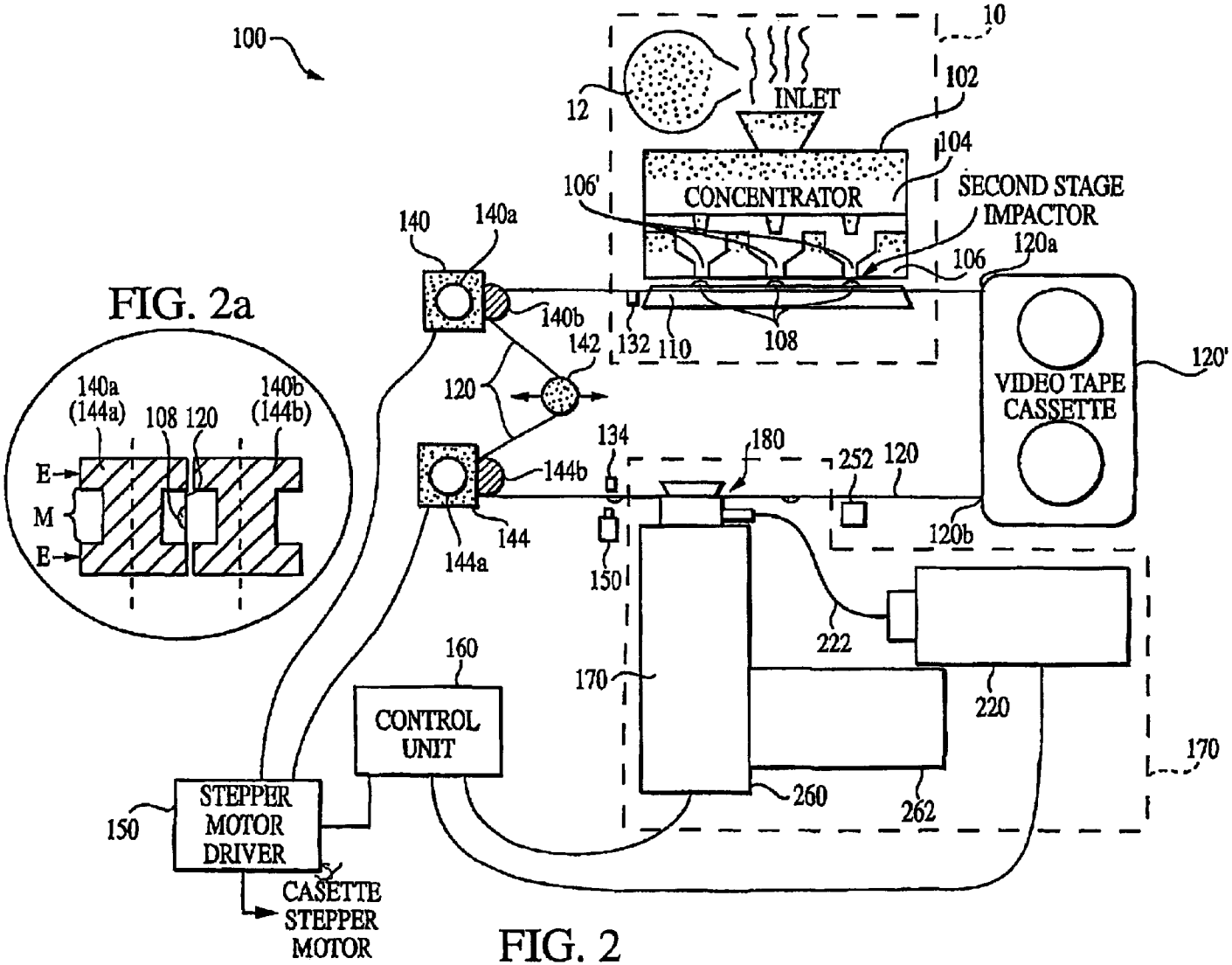
FIG. 2 is a schematic diagram of an embodiment of the system of the present invention.

The principal parts of the system 100 are illustrated in FIG. 2. The system 100 includes an aerosol interface 10 which provides means for preparing a sample which is to undergo mass spectrum analysis. In particular, a sample is prepared in accordance with a modified MALDI sample preparation technique in which a MALDI matrix is either co-deposited as an aerosol with the sample analyte, or applied with post-collection processing 252 before analysis in a mass spectrometer 22. The sample analyte is derived by collecting, concentrating and separating aerosols from a sample collector airflow 45 at concentrations of typically 15 ACPs per liter of air and of 0.5 to 10.0 um aerodynamic diameter onto a permanent storage medium such as a movable tape 120' (to be described).

As shown in FIG. 2, the mixing method of the present invention includes a matrix nebulizer 12 dispensing metered amounts of matrix into the sample collector airflow, thus avoiding the use of post-collection fluids. This process allows for intimate mixing of matrix and analyte throughout the deposited sample and negates the need for additional post-collection processing prior to introduction of the MALDI-analyte combination into the spectrometer.

As is appreciated in the art, the ability to generate UV-MALDI mass spectra is critically dependent upon the co-crystallization or very close spatial proximity of the analyte and a molar excess of the matrix compound. As currently practiced in conventional non-field deployable TOF-MS analyzers, UV-MALDI mass spectra is generated in accordance with a procedure in which a small volume of matrix solution that delivers a one thousand-fold molar excess of matrix is manually mixed with a small volume of the analyte solution which then dries on a sample stage. A spatially heterogeneous distribution of analyte and matrix typically develops as the droplet dries to form a sample spot. Under laboratory conditions, the incident laser is rastered across the sample to identify so called "sweet spots" that preferably yield an abundance of analyte ions. This technique is not applicable to a field deployable TOF MS, such as the one described herein, because constraints do not permit either the analyte and matrix to be mixed in solution and to raster the laser across the sample makes the system unnecessarily complex.

An alternate matrix application approach for a field-deployable automated TOF MMS system consists of depositing an analyte sample in aerosol from directly on tape pre-coated with a MALDI matrix. This does not provide the intimate mixing and co-crystallization of the analyte with the matrix that is essential for the generation of high quality UV-MALDI mass spectra. Thus, additional post-collection steps, e.g., using a dispenser 252 to apply MALDI matrix over the sample prior to introduction of the MALDI-analyte combination into a spectrometer, maybe required.

Figure 3:
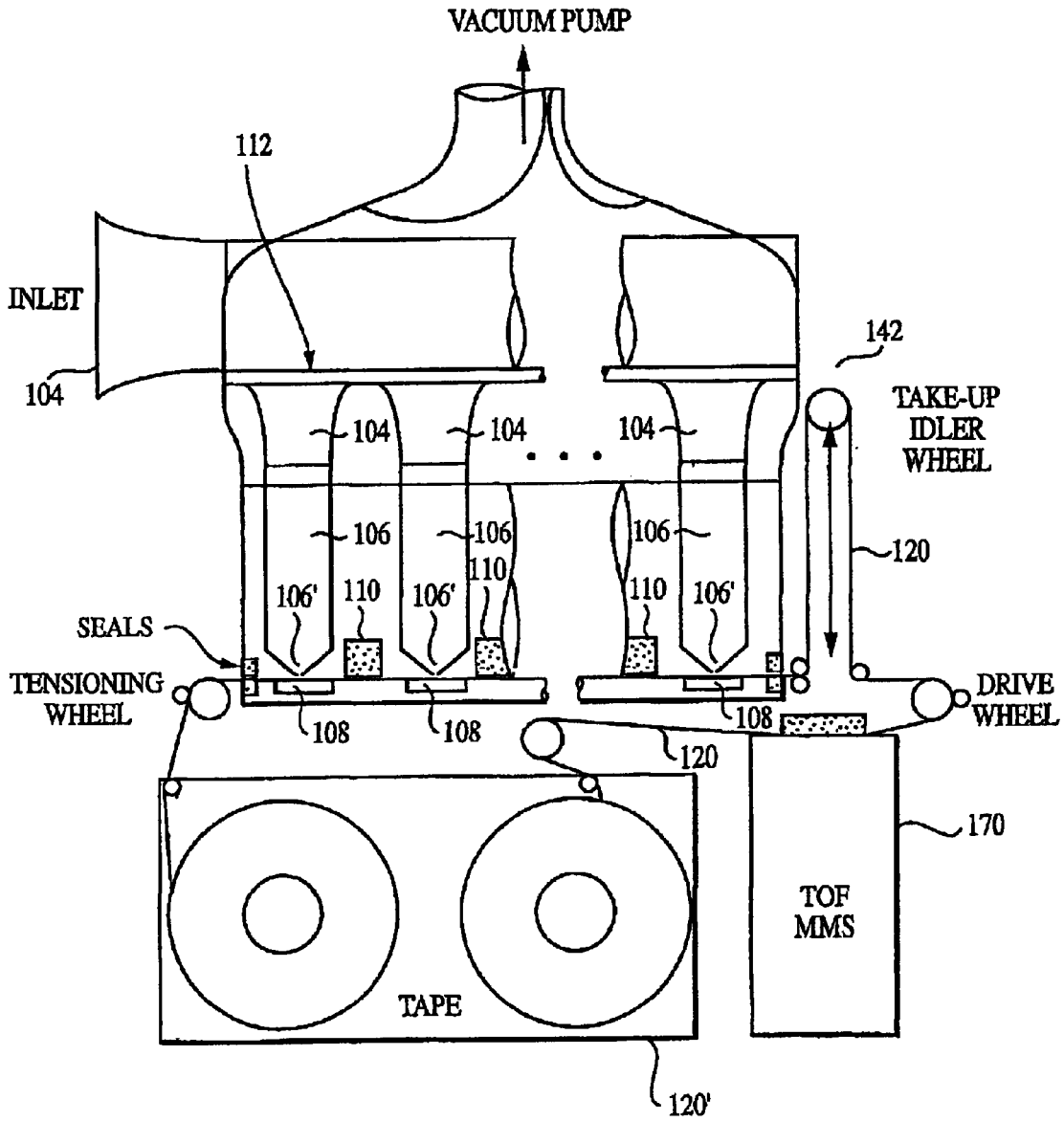
FIG. 3 depicts details of the aerosol interface of the system of FIG. 2.

Referring now to FIG. 3, a more detailed illustration of system 100 is shown. In one embodiment, the aerosol interface 10 includes one or more impactor/concentrator stations (104/106, one station is shown) which is made up of a concentrator 104 and a set of second stage impactors 106. The impactors 106 serve to separate the particles from the airflow and provide sample deposits 108 on a transport tape 120 through a number of impaction nozzles 106'. Interposed between the impactor/concentrator stations are one or more matrix-assisted laser desorption/ionization (MALDI) dispensers 110. The MALDI dispensers 110 re-wet the sample areas on the tape 120 to provide for additional concentration of aerosol at each impactor/concentrator station. This technique intersperses MALDI matrix as an aerosol with the sample analyte, thus requiring no post-collection processing before analysis in a mass spectrometer. Alternately, the dispensers, 110 may be located after the aerosol collection stage and before the spectrometer, 170, as shown in FIGS. 1 and 2, 252, to provide post-collection matrix application or over-spraying.

While impactors were chosen for this embodiment, other sample separator and collection systems may be used depending on the MMS application, e.g., collection from a solid surface may require a different approach from an application where the sample is collected from air.

The present invention solves the problems discussed above for an automated TOF MMS system suitable for field deployment by co-depositing the matrix with the analyte as an aerosol on video recorder tape.

The inventive mixing method, according to one embodiment, for co-depositing the matrix with the analyte as an aerosol on video recorder tape is now described in greater detail with reference to FIGS. 2 and 3. A nebulizer 12 is used to inject metered amounts of MALDI matrix particles into a sample collector airstream 45. The airstream 45 is drawn (via a vacuum) into a collector 102 via an inlet 104. Upon entering the collector 102, the airstream 45 passes through a concentrator/impactor station 104/106. The impactor 106 serves to separate the desired particles from the airstream and provide sample deposits 108 on a transport tape 120 (described further below) through a number of impaction nozzles 106'. The air collection portion so configured has a high throughput and high collection efficiency. Thus, a high concentration of dry particles are withdrawn from the environment and deposited on a small area of the tape 108 as shown. The collector 102 therefore collects particulate agents from the environment, such as biological agents and chemical agents that are attached to particles (such as residue of explosive material in the earth left by mine placement). Thus, the sample is not collected or transported in a liquid state, thus avoiding freezing, spoiling, etc. In addition, samples 108 deposited on the tape 120 are extremely thin, which is advantageous when introduced into the extraction region of the mass analyzer, as described further below.

After collection, the samples 108 are transported by the tape 120 for treatment and analysis. The tape 120 may be a standard VHS tape, which is withdrawn from a tape supply end 120*a* of a video cassette 120' and collected at the tape collection end 120*b*. The video tape 120 from the tape supply side 120*a* runs between the impaction nozzles 106' (from which the samples 108 are deposited, as described above) and a backing platen 113. The tape 120 is wound in a loop pattern between the drive shaft 140*a*, a take up idler wheel 142 and a rubber tape roller 140*b* of a first stepper motor 140, around a tensioning shaft and roller arrangement 142, and between a drive shaft 144*a* and a rubber tape roller 144*b* of a second stepper motor 144.

The tape 120 then passes through an input portion to the mass analyzer 170, and is then collected by the cassette 120' at the tape collection end 120*b*. Referring to FIG. 3, the take up tensioning shaft 142 provides for a variable length tape loop prior to the sample introduction into the mass analyzer 170. A similar function can also be provided with a vacuum column. The idler wheel 141 serves to allow incremental motion of the tape 120 under the impactors 106 independent of incremental motion of the tape 120 into the mass analyzer 170.

The tape 120 provides for permanent storage of samples which may be 'replayed' into the analyzer 170 at a later time. Separation of the sample collection areas on the tape so that they are not cross contaminated by winding on to a take up reel and contacting the backside of the tape is provided by limiting the contact to areas where other samples never touch, if the tape is rewound. This consistency of tape wrapping is controlled by the tensioning wheel and the consistency of the drive on the take up reel of the tape cartridge or reel so that each time the tape is played and re-wrapped on the take up reel the samples will contact the back side of the tape nearly in the same spot and never as far away as areas touched by adjacent samples.

A groove or notch in the drive wheel capstan and tape guide provides for tape motion without touching the sample area on the tape thus eliminating a possible source of cross contamination between the individual samples on the tape. Referring to FIG. 2*a* which illustrates a cross-section of the drive shafts 140*a*, 144*a* and the rubber tape roller 140*b*, 144*b* is shown, with the tape 120 there between. As shown, both the drive shafts 140*a* and 144*a* have a reduced diameter at a mid region M than at end regions E. The end regions E between the drive shafts 140*a*, 144*a* and the tape rollers 140*b*, 144*b* serve to pinch the edges of the tape 120, while the middle region M allows the sample 108 to pass through untouched. The friction the tape 120 and the drive shafts 140*a*, 144*a* created by the pinching between the drive shafts 140*a*, 144*a* and the tape rollers 140*b*, 144*b* allows the drive shafts 140*a*, 144*a* to advance the tape 120. Rollers of like grooved design placed along the tape path guide the tape lateral alignment.

Driving of the tape uses commercially available closed-loop motor control drivers for the positioning of the tape. The embodiment of FIG. 2 includes a three axis stepper motor driver 150 that receives control signals from control unit 160. The stepper motor driver 150 independently controls first stepper motor 140, second stepper motor 144 and a third stepper motor (not shown) that serves to load the video cassette 120'. By sending the appropriate control signals to the first stepper motor 140, a portion of the tape is positioned in the collector 102. By sending appropriate control signals to the second stepper motor 144 and coordinating simultaneous collection of the tape into the cassette by the third stepper motor, samples are positioned in the mass spectrometer vacuum interface 180. Thus, the tape segment associated with the collection of the samples moves independently of the segment associated with the analysis of the samples. Thus, additional samples may be collected by the collector 102 while a particular sample continues to be analyzed by the mass spectrometer 170. Controllable motors other that stepping motors may work as well for this application.

When the analysis is completed, the second stepper motor 144 is stepped by the control unit 160 to move the next sample into the mass analyzer 102. Likewise, samples may continue to be collected within unit 10 while independently moving previously collected sample into the analyzer. Upon completing the sample collection, the first stepper motor 140, controlled by unit 160, advances fresh tape into the collector 102 for collection of a subsequent sample. Tension is maintained in the tape 120 during independent movement of stepper motors 140, 144 because shaft 142 moves against spring tension as required in the directions of the arrows shown in FIG. 2 associated with roller 142.

The stepper motors 140, 144 (as well as the cassette stepper motor) may, of course, also be stepped together to position a collected sample 108 from the collector 102 to the mass analyzer 22. This may occur, for example, if the sampling is initiated manually (for example, by a security office at an airport gate), or during automatic collection and processing where a remote command provides instructions to bypass the analysis of the last sample and proceed with analysis of the actively collected samples. In any case, the control unit 160 keeps track of the movement of each sample 108 leaving the concentrator 102 by using magnetic write head 132 to write a reference marking on the tape 120 adjacent the exiting sample 108, and by tracking control motor rotation angles.

As described below, a read head prior to the mass analyzer is used to identify and provide a position of the sample 108 to the control unit 160. Thus, the control unit 160 uses stepping motor counts and magnetic tape markings to keep track of the position of the sample 108 while being transported between the collector 102 and the mass analyzer 170. For ease of description, the ensuing description will focus on the collection of a single sample 108 by the collector 102 and its treatment, transport and analysis by the mass analyzer.

Following collection of sample 108 by collector 102, association of a reference marking by write head 132 and movement of the sample 108 through the tape loop of the stepper motors (described above), a magnetic read head 134 reads the reference marking on the tape 120 associated with sample 108 provided by write head 132. This identifies the sample 108 to the control unit 160 and also provides a reference position for subsequent movement by the control unit 160. Using the reference position, the control unit 160 steps stepper motor 144 by a known amount to position sample 108 adjacent the nozzle of a MALDI micro dispenser 150. The MALDI micro dispenser 150 adds a small amount of MALDI matrix to the sample to facilitate ionization in the mass spectrometer (described below), especially for desorption of large macromolecules previously described. The MALDI treatment provides a small amount of matrix, thus the sample 108 remains relatively flat. In addition, the post-collection MALDI treatment occurs just prior to introduction into the mass analyzer, thus minimizing exposure to the elements.

The control unit 160 then steps stepper motor 144 by a known amount to move treated sample 108 into the mass analyzer 170. The software run by the control unit 160 and the stepper motors position the sample 108 within $1/10^{th}$ the diameter the sample target region of the mass analyzer 170, thus ensuring that the sample 108 is illuminated with the laser, as described further below.

Figure 4:
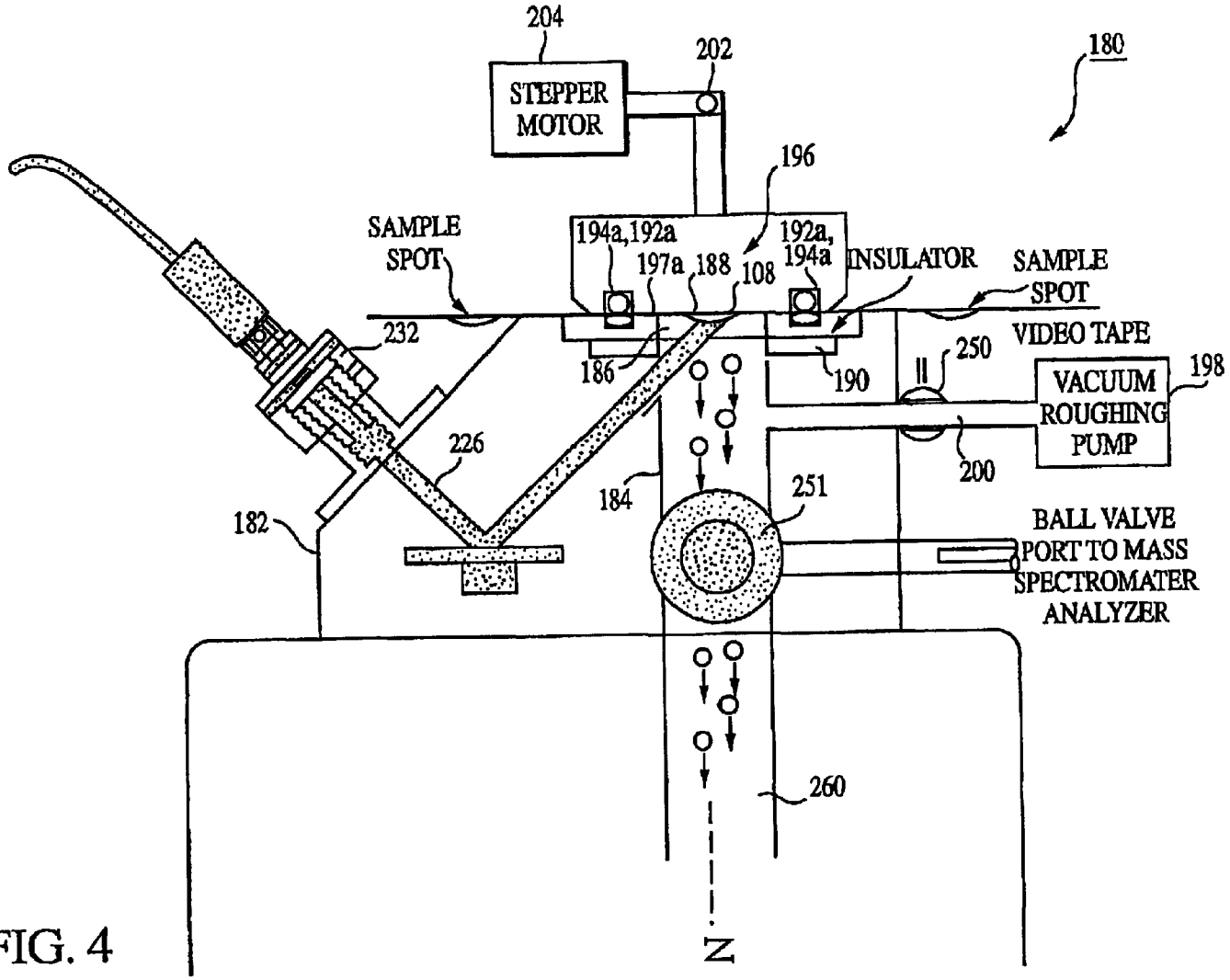
FIG. 4 is a partial perspective view of the external ionization source and vacuum interface portion of the system of FIG. 2.

Referring now to FIG. 4, in accordance with another aspect of the present invention, an improved design is provided whereby an extraction ionization source 190 and 194 is located outside the vacuum chamber 260 to a location between the sample surface and an isolation valve. In a conventional design, the ionization cell normally resides within the walls of the vacuum chamber 260 and is reachable only by a long probe. The improved design of the present invention removes the requirement of using a long probe and associated multiple vacuum seals.

The inventive external ionization source reduces the complexity of repeatedly breaking and restoring a high-vacuum seal as each tape sample is repositioned over the sample port. Eliminating the need for a probe allows this invention to use a sample collection substrate consisting of continuous tape [or disk, or other medium]. This adds the capability of rapidly advancing a continuous series of samples through the MS analyzer stage. In a conventional design where the extraction source is located inside the vacuum chamber 260, typically many tens of minutes are required to restore the mass analyzer chamber to a high vacuum if the whole chamber were exposed to the atmosphere. The vacuum interface of the present invention reduces the vacuum pump loading by isolating the main vacuum chamber 260 from the sample port around the tape sample when samples are being changed, while simultaneously providing a clear passage for the ions during a measurement (described further below).

In FIG. 4, the external extraction source-valve design for an MMS is shown which retains certain desired features of the prior art, e.g., providing space for an electrostatic lens and allowing a laser beam 232 to impact a sample surface 108 directly, but is different in that it locates the extraction source outside the vacuum chamber 260 to a location between the sample surface 108 and the valve. The novel configuration eliminates the need to introduce the sample 108 into the vacuum chamber via a long probe by overcoming the dimensional separation (i.e., between the sample surface and extraction source) caused by the valve mechanism. That is, the correct sample-surface and extraction source electric field geometry needed for the proper voltage potential gradient and sample ion acceleration is achieved with the placement of the extraction source outside the chamber.

The external placement of the extraction source advantageously provides sufficient room for an isolation valve which facilitates the collection and sample preparation techniques of the present invention. Without the external source, an isolation valve could not fit in the space between the source and the sample collection substrate. The sample collection tape 120 serves to form the vacuum seal. This function was performed by an extended probe in the conventional design. The tape 120 must be made of a nonporous material that holds a vacuum seal at or below micro-Torr pressure levels such as, for example, a polyester film as used for magnetic recording tape. Candidate materials also include a wide variety of polyester, polyamide, and polytetra fluoroethylenes. In general, any tape material sufficient to hold an adequate vacuum is a candidate material.

With continued reference to FIG. 4, additional details of the ionization source 190, 194 and vacuum interface 180 of the mass analyzer portion 170, is shown. The interface 180 comprises housing 182 having a roughing vacuum chamber portion 184 therein, and a pressure platen 196. A sample 108 is introduced into the vacuum system of the mass analyzer by moving tape 120 so that sample 108 is positioned in upper opening 186 of roughing vacuum chamber portion 184. An insulating disc 188 surrounds the upper opening 186 and is supported by an electrode assembly 190 that projects axially from the roughing vacuum chamber portion 184. The upper surface of the insulating disc 188 is flush with the upper surface of the housing 182, thus providing an even surface across which the tape 120 extends. An O-ring 192 is positioned in circumferential groove 194 in the surface of the insulating disc 188.

When the sample 108 is positioned, the stepper motor 204 is stepped by control unit 160 to position the source ionization platen 196 over the sample 108 and the upper opening 186. Platen assembly 196 is an insulating material with a set of electrodes 197*a*, surrounding the opening 186, which create an electric field with the electrodes 190, and form an electrostatic lens to focus the ions on the MS detector. The platen 196 has a circumferential groove 194*a* and O-ring 192*a* in its bottom surface opposite the circumferential groove 194 and O-ring 192 of the insulating disc 188. When the platen 196 is positioned as shown, and 196 is drawn downwards, the compression of 192, 192*a* creates a vacuum seal in the roughing vacuum chamber portion 184.

While the sample 108 is being positioned, the roughing vacuum chamber portion 184 is exposed to atmospheric pressure. A ball valve 251 remains closed during the positioning process to isolate the high vacuum (micro-Torr) in the mass spectrometer vacuum chamber 260. This is done via a motor (not shown) associated with the ball valve 251 that receives commands from the control unit 160 when a new sample 108 is to be positioned. The roughing pump 198 is switched off by the control unit 160 and the vacuum in roughing vacuum chamber portion 184 rises to atmospheric pressure. Control unit 160 moves platen 196 away from upper opening 186 in the Z direction by sending the appropriate stepping signals to stepper motor 204, which removes platen 196 via cantilever arms 202. Stepper motor 144 is then stepped by control unit 160 so that tape 120 positions the next sample 108 in line with the upper opening 186. Guides keep the sample from contacting the top surface of housing 182 and insulating disc 188 during positioning. Once the sample 108 is in position, motor 204 is activated to close platen 196. This compresses the tape between O-rings 192*a* and 194*a* to from a vacuum seal. Control unit 160 initiates a vacuum roughing pump 198, which evacuates the roughing vacuum chamber portion 184 through port 200. It has been experimentally determined that approximately 10 seconds is required to rough the vacuum chamber portion 184. After the roughing operation is complete (removal of the air), the roughing pump ball valve 250 closes and the isolation valve 251 opens. This creates a direct straight-line path from the sample surface 108 to the spectrometer detectors (not shown). At this point, approximately 20 additional seconds is required to pump the cavity 235 to a micro-Torr pressure. Once at high vacuum, a potential of at least 4,600 V is applied between an electrode on the contact surface inside the sealing ring of the platen 196 and the extraction source electrodes 190. A laser 232 then ionizes the sample by firing a beam 226 through an optically clear vacuum window to a spot focused on the tape surface. The vacuum isolation valve 251 closes upon completion of the spectrometer measurement, the roughing port valve 250 opens, and the platen 196 releases, allowing the tape to advance for the next measurement. In practice, valves 250 and 251 may be combined in a single three-port-two position valve. Tests thus far have demonstrated the capability to handle extraction voltages exceeding 6,000 V, with feasible designs up to 12,000 V. The seal between the platen 196 and the O-ring 192 has a Helium leak rate of less than $10^{-7}$ cc/s, which is well within the capability of the vacuum pump to maintain the required micro-Torr vacuum.

To prevent deformation of the tape 120 caused by a pressure differential between the two sides of the tape 120, the platen 196 contains a port opening on the backside of the tape. The port connects to a compensating vacuum formed by the main vacuum chamber. This compensating vacuum eliminates the differential pressure forces, thereby preventing unacceptable tape deflection. Alternatively, the tape may be perforated with pins during closure to the aerosol platen 113 during the aerosol collection step. The perforations allow excavation of the volume between the tape and the source ionization platen 196, which equalizes the pressure across the tape and minimizes tape deformation.

In summary, numerous benefits have been described which result from employing the concepts of the present invention. Advantageously, the apparatus of the present invention provides for real-time mass spectra analysis. As used herein, the term "real-time" refers to the apparatus and accompanying methods which provides for the collection, concentration and separation of aerosols onto a permanent storage medium (the tape) and for advancing the concentrated samples into an analyzer instrument one at a time for analysis while continuously sampling new aerosols. It will be further appreciated that the apparatus 100 may run automatically and be readily used by unskilled personnel for field analysis of biological samples.

It will be understood that various modifications may be made to the embodiments disclosed herein, and that the above descriptions should not be construed as limiting, but merely as exemplifications of preferred embodiments. Those skilled in the art will envision other modifications within the scope and spirit of the claims appended hereto.

What is claimed is:

1. A field portable mass spectrometer system comprising:

a) an aerosol interface comprising:

an inlet having a vacuum therein, the inlet collecting an environmental specimen containing one or more analytes; and a nebulizer for injecting metered amounts of MALDI matrix particles into the environmental specimen prior to the inlet collecting the environmental specimen;

b) a sample transporter, the sample transporter interfacing with a sample collector to receive sample deposits thereon;

c) a time of flight (TOF) mass spectrometer, the time of flight mass spectrometer having a sealable opening that receives the sample transported via the sample transporter in an extraction region of the mass spectrometer; and d) a control unit that processes a time series output by the mass spectrometer for a received sample and identifies one or more agents contained in the sample.

2. The field portable mass spectrometer system of claim 1, wherein the metered amounts of MALDI matrix particles mixed with the one or more analytes contained in the environmental specimen form a spatially heterogeneous distribution of analyte and matrix.

3. The field portable mass spectrometer system of claim 1, wherein the metered amount of matrix solution injected into the environmental specimen is adjusted in accordance with differing amounts of environmental background.

4. A field portable mass spectrometer system comprising:

a) an aerosol interface comprising:

an inlet having a vacuum therein, the inlet collecting an environmental specimen containing one or more analytes; and one or more tape particle collector/impactor stations for collecting, concentrating and separating said one or more analytes contained in said environmental sample;

b) a sample transporter, the sample transporter interfacing with a sample collector to receive sample deposits thereon:

c) a time of flight (TOF) mass spectrometer, the time of flight mass spectrometer having a sealable opening that receives the sample transported via the sample transporter in an extraction region of the mass spectrometer; and d) a control unit that processes a time series output by the mass spectrometer for a received sample and identifies one or more agents contained in the sample.

5. A field potable mass spectrometer system comprising:

a) an aerosol interface;

b) a sample transporter, the sample transporter interfacing with a sample collector to receive sample deposits thereon, the sample transporter comprising a tape that receives the sample deposits from the sample collector, the tape being received at the scalable opening of the mass spectrometer, thereby allowing a sample thereon to be received in the extraction region of the mass spectrometer, the movement of each small being tracked between the sample collector and the mass spectrometer by using a magnetic write head to write a reference marking on the tape adjacent the sample upon exiting the sample collector;

c) a time of flight (TOF) mass spectrometer the time of flight mass spectrometer having a scalable opening that receives the sample transported via the sample transporter in an extraction region of the mass spectrometer and d) a control unit that processes a time series outwit by the mass spectrometer for a received sample and identifies one or more agents contained in the sample.

6. The field portable mass spectrometer system of claim 5, wherein the tape is perforated during the time that it receives sample deposits thereby permitting equalization of pressure across the tape and resultant minimization of tape deformation when the tape with sample thereon is received at the sealable opening of the mass spectrometer.

7. A field portable mass spectrometer system comprising:

a) an aerosol interface;

b) a sample transporter, the sample transporter interfacing with a sample collector to receive sample deposits thereon;

c) a time of flight (TOF) mass spectrometer, the time of flight mass spectrometer having a scalable opening that receives the sample transported via the sample transporter in an extraction region of the mass spectrometer, wherein the sealable opening and the extraction region of the TOF mass spectrometer are provided in a housing attached to or part of the TOF mass spectrometer and the housing further comprises a roughing vacuum chamber portion that connects between the sealable opening of the housing to a vacuum valve; and d) a control unit that processes a time series outwit by the mass spectrometer for a received sample and identifies one or more agents contained in the sample.

8. The field portable mass spectrometer system of claims 1, 4, 5, or 7, wherein movement of the tape when interfacing with the sample collector is independent of movement of the tape when being received in the mass spectrometer.

9. The field portable mass spectrometer system of claims 1, 4, 5, or 7, wherein the sample transporter further comprises a first controllable motor that receives control signals from the control unit and enables independent movement of the tape when interfacing with the sample collector and a second controllable motor that receives control signals from the control unit and enables independent movement of the tape when being received in the mass spectrometer.

10. The field portable mass spectrometer system of claims 1, 4, 5 or 7, wherein the TOF mass spectrometer comprises a linear TOF mass spectrometer.

11. The field portable mass spectrometer system of claims 1, 4, 5 or 7, wherein the TOF mass spectrometer comprises a linear and/or reflectron TOF mass spectrometer.

12. The field portable mass spectrometer system of claim 8, wherein the independent movement of the tape is provided at least in part by a movable tensioner that interfaces with the tape, the movable tensioner being interposed between the sample collector and the mass spectrometer.

13. The field portable mass spectrometer system of claim 12, wherein the tensioner is a spring-loaded shaft and roller arrangement, the tape being wound around at least a part of the shaft and roller components.

14. The field portable mass spectrometer system of claim 12, wherein the consistency of tape wrapping in a tape cartridge is controlled by the tensioner and the consistency of a drive on a take up reel of the tape cartridge such that the contact point on the backside of the tape for a sample is limited to areas where other samples never touch thereby allowing samples deposited on the tape to be permanently stored for later analysis without being cross contaminated by other samples deposited on the tape.

15. The field portable mass spectrometer system of claim 14, wherein the hint and second controllable motors each comprise a drive shaft and tape roller, the drive shaft and tape roller each having a groove formed therein such that the end regions of the drive shaft and tape roller contact and drive the tape while the groove prevents the sample from contacting the drive shaft and tape roller and thereby contaminating other samples.

16. The field portable mass spectrometer system of claim 7, wherein the housing further comprises a removable cover that is engageable with the sealable opening, the removable cover and the sealable opening forming a vacuum seal when engaged.

17. The field portable mass spectrometer system of claim 16, wherein a roughing pump interfaces with the roughing vacuum chamber portion and serves to evacuate the roughing vacuum chamber portion when (a) the vacuum seal is formed between the removable cover and the sealable opening and (b) the vacuum valve is closed.

18. The field portable mass spectrometer system of claim 16, wherein the vacuum seal is provided by at least one o-ring in each of the removable cover and the sealable opening the o-rings engaging to form a vacuum seal when the removable cover engages the sealable opening.

19. The field portable mass spectrometer system of claim 16, wherein the cover is a platen.

20. The field portable mass spectrometer system of claim 16, wherein a surface of the cover that covers the sealable opening comprises an electrode and defines one end of an extraction region of the TOF mass spectrometer in the roughing vacuum chamber portion.

21. The field portable mass spectrometer system of claim 20, wherein one or more additional electrodes surrounding the roughing vacuum chamber portion and lying between the sealable opening and the vacuum valve defines an another end of the extraction region.

22. The field portable mass spectrometer system of claim 21, wherein a vacuum pump that interfaces with a main mass spectrometer vacuum chamber serves to evacuate the main mass spectrometer vacuum chamber.

23. The field portable mass spectrometer system of claim 22, wherein an open valve between the main mass spectrometer vacuum chamber and the extraction region forms part of the time of flight path of the spectrometer.

24. The field portable mass spectrometer system of claim 23, wherein the vacuum pump that interfaces with the main mass spectrometer vacuum chamber serves to evacuate the main mass spectrometer vacuum chamber and the roughing vacuum chamber when the valve is opened, thereby providing a connected vacuum between the main mass spectrometer vacuum chamber and the roughing vacuum chamber when the valve is opened.

25. The field portable mass spectrometer system of claim 24, wherein the sample transporter comprises a tape and the removable cover contains a port opening on the backside of the tape, the port opening being connected to a compensating vacuum formed by the main mass spectrometer vacuum chamber, the compensating vacuum eliminating differential pressure forces thereby preventing unacceptable tape deflection.

* * * * *